United States Patent [19]

Nasby et al.

[11] Patent Number: 5,007,571

[45] Date of Patent: Apr. 16, 1991

[54] SPROCKET FEED STRIP REMOVER

[75] Inventors: James S. Nasby, Skokie; Michael J. Rood, Hoffman Estates, both of Ill.

[73] Assignee: Perf-Mate Company, Skokie, Ill.

[21] Appl. No.: 237,955

[22] Filed: Aug. 29, 1988

[51] Int. Cl.[5] ..... B26F 3/02

[52] U.S. Cl. ..... 225/106; 225/93

[58] Field of Search ..... 225/106, 1, 93

[56] References Cited

U.S. PATENT DOCUMENTS

| | | | |
|---|---|---|---|
| 2,782,856 | 2/1957 | Staley | 30/363 |
| 3,838,953 | 5/1975 | Saullo et al. | 30/304 |
| 4,529,113 | 7/1985 | Elliott | 225/1 |
| 4,657,163 | 4/1987 | Cats | 225/106 |
| 4,782,986 | 11/1988 | Loesche | 225/106 |
| 4,886,198 | 12/1989 | De Larosiere | 225/106 |

*Primary Examiner*—Hien H. Phan

*Attorney, Agent, or Firm*—Lockwood, Alex, FitzGibbon & Cummings

[57] ABSTRACT

A manually operable clamp for removing the sprocket feed margin strips from continuous computer print-out paper when the strips are removably attached along perforated tear lines. In the preferred form, the jaws of the clamp are integrally connected by a live hinge and have elongated rectangular mating clamping surfaces which are provided by U-shaped channel portions of the jaws. The clamping surface of one jaw has a plurality of pin-receiving openings therein while a plurality of pins project from the other clamping surface. The size and spacing of the sprocket tooth receiving openings in the margin strips. The inner side of the U-shaped channel portion of the jaw having the clamping surface with pin-receiving openings serves as a fence against which the elongated edges of margin strip abut when the openings in the margin strips are in alignment with the pin-receiving openings. One end only of the clamping surface having the pin-receiving openings also has an margin strip positioning abutment which is engaged by one end of the margin strips.

5 Claims, 2 Drawing Sheets

5
6
7
8
30
31
18

SPROCKET FEED STRIP REMOVER

This invention relates generally to innovations and improvements in manually operable clamp-type devices for use in removing perforated (removable) sprocket feed strips from computer printer paper and printer type forms. The clamp can be used as a hand-held or desk top device or may be permanently installed as a countertop device.

Printers are in widespread use in association with computers or word processors. One of the main types of printers operates with computer printer forms and paper of the "sprocket feed" type which forms and paper are usually provided in so-called "fan fold" condition. Such computer printer forms and paper include separable or tear-away margin strips connected to main bodies of the forms and paper by lines of perforations allowing the margin strips to be removed so as to leave the print-out product in a standard stationary width, e.g. 8.5 inches. The margin strips are provided with holes between the outer edges of the strips and the line of perforations which holes are engaged by sprocket teeth of the printer mechanism so as to feed the forms or printer paper through the printer.

While the margin strips can be torn away or removed from the print-out product by hand, this is a tedious operation if more than a few sheets are involved and unless done slowly and carefully often results in tearing the main body of the paper and also leaves small portions of the margin strips attached which have to be removed one by one. Hence, there has been a demand for a mechanical means to facilitate the margin strip removal operation both in respect to speeding up the operation and performing it without tearing the main body of the paper on the one hand or leaving small pieces of the margin strips attached and requiring follow-up removal. This demand has been met previously by two main types of margin strip removing devices. One main type is a relatively inexpensive manually operable device. The other type is a relatively expensive machine usually used in direct association with a printer so as to receive the print-out product from the printer and continuously separate the margin strips. As previously indicated, the present invention relates to the first type, i.e. the manually operable, relatively inexpensive type.

The prior art discloses two different forms of the manually operable, relatively inexpensive type margin strip remover, one being disclosed in U.S. Pat. No. 4,529,113 issued July 16, 1985 to Judith D. Elliott and the other being disclosed in U.S. Pat. No. 4,657,163 issued Apr. 14, 1987 to Pier C. M. Cats. A manually operable device corresponding to U.S. Pat. No. 4,657,163 is commercially available under the name "Easy Strip".

The present invention in its preferred form is integrally molded in one piece from a known plastic such as polypropylene so as to embody an elongated live hinge integrally connecting two clamping jaws. The opposing lips of the jaws are provided with formations which are strong and rigid and have elongated rectangular clamping surfaces which mate together when the device is empty and which engage opposite sides of a stack of margin strips in use. One of the elongated clamping surfaces has a plurality of pin-receiving openings which correspond in size and spacing to the sprocket tooth receiving holes in the margin strips to be removed. This same clamping surface also has an integrally formed fence or abutment extending along its inner side which provides an elongated vertical surface against which the longitudinal or elongated edge of the margin strips can be brought into engagement and thereby bring the openings therein in alignment with the pin-receiving openings in the clamping surface. The other clamping surface on the other jaw has a plurality of pins protruding therefrom which enter into the pin-receiving openings in the opposing jaw when the jaw are closed together. The dimensions of the pins and pin-receiving openings correspond relatively closely to the sizes of the sprocket tooth openings in the margin strips. Preferably, the portions of the clamping jaws which provide the clamping surfaces are U-shaped in cross-section thereby taking the form of elongated channels which have inherent rigidity for the amount of material involved. Further, one end only of the clamping surface having the pin-receiving openings is provided with an abutment against which one end of a stack of margin strips may be brought into engagement so as to position the holes in the margin strips in registration with the pin-receiving openings.

The object of the present invention, generally stated, is the provision of an economical, mass-producable clamp for removing the perforated margin strips from computer print-out forms and paper which is easier and more convenient to use than known manually operable devices of the same type and which provides a better margin strip removal function than known devices of the same type.

An important object of the invention is the provision of a manually operable clamping device for removing the perforated margin strips from computer print-out forms and paper embodying the following features:

(a) has an integral elongated live hinge allowing the device to accommodate stacks of print-out margins varying substantially in numbers (e.g. 1 to 25 or more);

(b) provides means for accurately loading a stack of margin strips into the device so that the jaws can be closed together in clamping relationship without having to shift the position of the stack of strips; and (c) has rigid clamping lip formations which are in the form of elongated U-shaped channels.

Certain other objects of the invention will appear from the following detailed description of a preferred embodiment of the invention taken in connection with the accompanying drawings wherein.

Figures 1, 2, 3, 4:
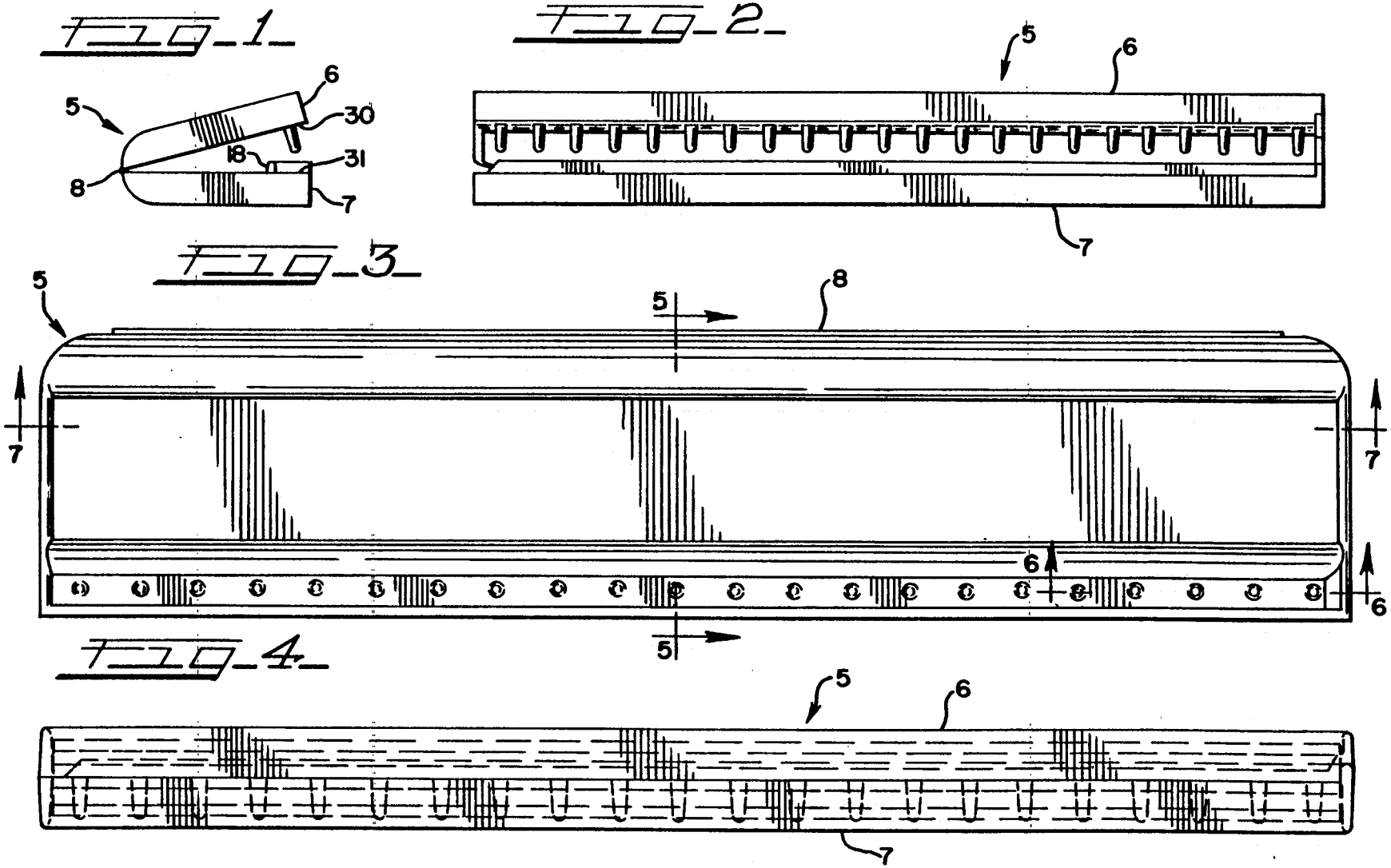
FIG. 1 is an end elevational view of a clamp embodying the present invention for removing the perforated sprocket feed margin strips from computer print-out forms and papers, the clamp being shown in its open condition.
FIG. 2 is a front elevational view of the clamp shown in FIG. 1.
FIG. 3 is an enlarged top plan view of the clamp shown in FIGS. 1 and 2.
Figure 5:
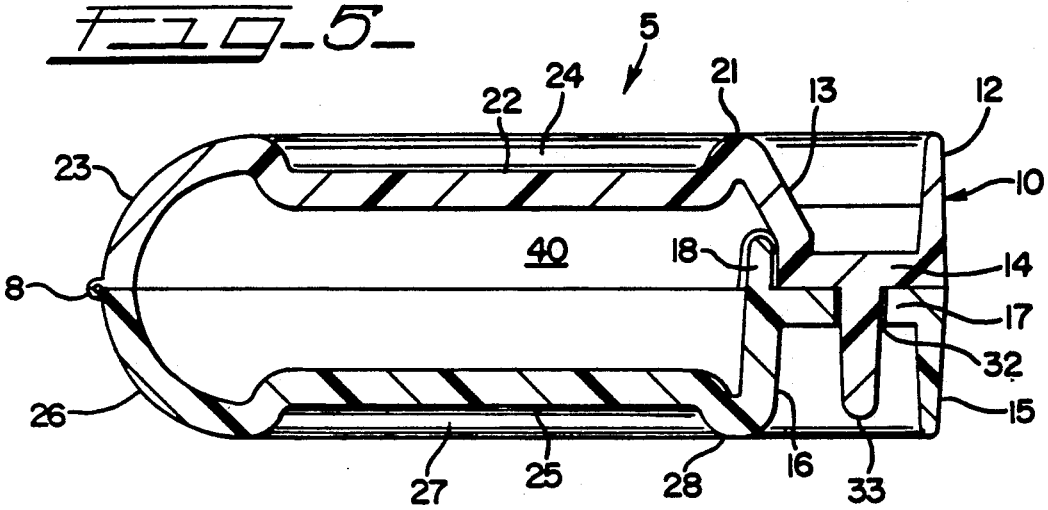
Figure 6:
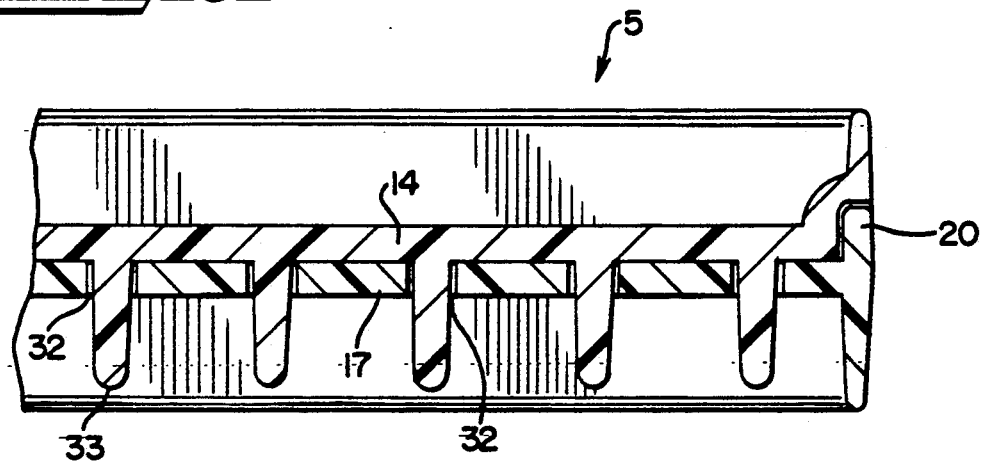
Figure 7:
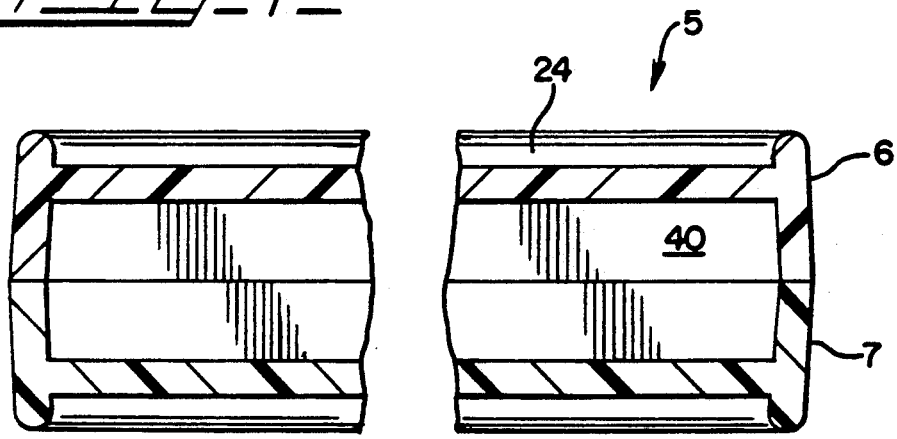

FIG. 4 is an enlarged elevational responding to FIG. 2 but with the jaws of the clamp in closed condition; and FIGS. 5, 6, and 7 are vertical sectional views taken on lines 5—5, 6—6, and 7—7, respectively, of FIG. 3.

In the drawings, the clamping device of the present invention is indicated generally at 5. The clamp 5 is integrally molded in one piece from a suitable material such as polypropylene so as to have an upper jaw 6, a lower jaw 7 integrally connected at the back or rear by a live hinge 8. As is known, the live hinge 8 comprises a relatively thin elongated portion of the material from which the clamp 5 is molded. The hinge 8 is strong enough so as to maintain the jaws 6 and 7 in their proper alignment. However, as will appear more fully, the hinge 8 allows sufficient relative shifting between the jaws 6 and 7 so as to permit it to operate with stacks of perforated sprocket feed margin strips varying substantially in thickness as from one or two thicknesses to 25 or more. At their distal or front ends, the jaws 6 and 7 have generally U-shaped elongated channel formations indicated generally at 10 and 11 at FIG. 5. The channel 10 of the upper jaw 6 has an outer upright side 12, an inner rearwardly inclined side 13 interconnected by a horizontal floor portion 14. The elongated channel 11 of the lower jaw 7 has an outer vertical side 15 and inner vertical side 16 interconnected by a horizontal floor portion 17.

Rising above the upper surface of the floor portion 17, there is integrally formed a elongated fence member 18 and at one end of the channel 11 an abutment 20 (FIG. 6) which extends transversely and joins the fence 18 at a right angle.

The longitudinal top edge 21 (FIG. 5) of the inner inclined side 13 of the upper channel 10 and the live hinge 8 are integrally interconnected by a section 22 and a rear arcuate section 23. The section 22 is generally horizontal when the clamp 5 is closed and is sunken or recessed so as to provide a depression 24. Likewise, the longitudinal bottom edge of the inner side 16 of the lower channel 11 and the hinge 8 are interconnected by an inset planar section 25 and an arcuate section 26. The section 25 is recessed so as to provide a recessed area 27 which may be used to receive means to permanently position the clamp on a working surface.

The depressed area 24 and recessed area 27 result in the upper longitudinal edge 21 and the lower longitudinal edge 28 being exposed and constituting gripping ledges that assist the user in manually manipulating the clamp 5.

It will be seen that the bottom surface of the floor 14 of the upper channel 10 and the upper surface of the floor 17 of the lower channel 11 are elongated and rectangular in shape and mate together as shown in FIGS. 5, 6 and 7. These mating surfaces are indicated at 30 and 31 respectively in FIG. 1. The width of the mating surfaces 30 and 31 corresponds to the standard width of the sprocket feed margin strips that are to be separated along their perforated tear lines. The fence 18 rises from the inner edge of the lower clamping surface 31 so as to provide an abutment surface or stop against which the outer longitudinal edges of a stack of margin strips may be placed so as to place the line of perforations thereof over the outer edge of the clamping surface 31. At the same time, the sprocket holes in the stack of margin strips will be aligned longitudinally with the pin-receiving holes 32—32 (FIG. 6) in the floor 17 of the channel 11.

By providing the abutment or stop 20 on one end only of the clamping surface 31, it will cooperate with the fence 18 so that the with the outer elongated edge of a stack of margin strips abutting the fence 18 and one end of the stack of margin strips abutting against the stop 20, the sprocket openings in the margin strips will be brought into registration with the openings 32.

The floor 14 of the upper channel formation 10 is provided with a plurality of pins or teeth 33—33 on the underside which are so spaced and positioned that they fit into the holes or openings 32 when the clamp jaws 6 and 7 are closed together as shown in FIGS. 5 and 6.

Preferably, the pins 33 are tapered and at their roots or proximal ends they have diameters approximately the same as the diameters of the holes in the margin strips so as to have a free but not sloppy fit therewith. Likewise, the holes 32 are sized so as to be approximately the same size as the sprocket holes in the margin strips and thereby freely receive the pins 33.

It will be apparent from FIGS. 1 and 5 that when the jaws 6 and 7 of the clamp 5 are in the open condition, the pins 33 will be inclined somewhat and will move through an arc as the jaws are closed together and the pins 33 are brought into a substantially vertical position as shown in FIG. 5. If a relatively thick stack of margin strips are in place in the clamp (e.g. 25 sheets), it will be seen that the distal ends or tips of the pins 33 will tend to enter the sprocket holes in the stack of margin strips at the top and at the back or rear of the holes. Then, as the jaws 6 and 7 are brought together to the position where the upper clamping surface 30 and the lower clamping surface 31 retain the stack of margin strips in compressed gripping condition therebetween there will be a tendency for the stack of margin strips to tilt rearwardly and a tendency for the upper jaw 6 to shift forwardly relative to the bottom jaw 7. The flexibility of the longitudinal live hinge 8 materially assists in permitting this relative shifting and accommodation of the clamp to stacks of varying thicknesses.

Referring to FIGS. 5 and 7, it will be noted that there is a chamber or cavity 40 of substantial size within the confines of the jaws 6 and 7 when they are closed together. This space or cavity serves as a temporary receptacle for storing removed margin strips until such time as they can be properly disposed of. Thus, in use after the operator has placed the margin strips of a stack of printer print-out forms or paper in the clamp 5 and has removed the main body of the paper or forms by firmly holding the clamp 5 in one hand and separating the margin strips along their line of perforations by pulling on the same with the other hand, this residual stack of removed margin strips can be dumped into the chamber 50 by turning the clamp 5 vertically on the live hinge 8 and opening the jaws 6 and 7 so as to allow the removed margin strips to fall into the chamber 40 after the pins 33 have been withdrawn therefrom. The clamp 5 is integrally molded by known molding techniques in the open condition and then after being removed from the molds in the still warm condition, the jaws 6 and 7 are closed under such conditions that after the parts have set, when the jaws 6 and 7 are released they will automatically open to approximately the condition shown in FIG. 1 wherein the clamp is ready to receive the margin strips of a stack of print-out forms or paper.

What is claimed is:

1. A manually operable clamp for removing a margin strip from printer paper having sprocket feed margin strips containing spaced sprocket tooth receiving openings and detachably connected to the main body of the printer paper by a tear line of perforations, comprising:

upper and lower jaws connected by a longitudinal live hinge, each said jaw having an elongated rectangular clamping surface which is matingly engageable with a corresponding opposed elongated rectangular clamping surface and on the other jaw;

one of said jaws having a portion that includes one of said clamping surfaces and has within said one clamping surface a plurality of aligned pin-receiving openings therein corresponding in size and spacing to said sprocket tooth receiving openings and said portion also having inwardly of said pin-receiving openings and parallel thereto longitudinal fence means against which the elongated edges of said margin strips abut when said sprocket tooth receiving openings therein are in registration with said pin-receiving openings;

the other jaw having a portion that includes the other of said clamping surfaces and has within said other clamping surface a plurality of aligned pins projecting therefrom corresponding in size, number and spacing to said pin-receiving openings and matingly insertable therein when said jaws are closed with said clamping surfaces engaged; and live hinge having sufficient flexibility so as to allow sufficient shifting of said jaws relative to each other to permit said pins to enter said sprocket receiving holes in stacks of various thickness of said margin strips.

2. A manually operable clamp for removing a margin strip from printer paper having sprocket feed margin strips containing spaced sprocket tooth receiving holes and detachably connected to the main body of the printer paper by a tear line of perforations, comprising:

hinged upper and lower jaws, each jaw having an elongated rectangular clamping surface which has mating engagement with an opposed elongated rectangular clamping surface on the other jaw;

one of said jaw having a portion that includes one of said clamping surfaces and has within said one clamping surface a plurality of aligned pin-receiving openings therein corresponding in size and spacing to said sprocket tooth receiving openings and said portion also having inwardly of said pin-receiving openings and parallel thereto longitudinally fence means against which the elongated edges of said margin strips abut when said sprocket tooth receiving openings therein are in registration with said pin-receiving openings;

the other jaw having a portion that includes the other of said clamping surfaces and has within said other clamping surface a plurality of aligned pins projecting therefrom corresponding in size, number and spacing to said pin-receiving openings and matingly insertable therein when said jaws are closed with said clamping surfaces engaged; and said portions of said jaws including said clamping surfaces being in the form of elongated U-shaped channels having floor portions interconnecting the side portions thereof and with said elongated rectangular clamping surfaces being the outer surfaces of the floor portions of said channels.

3. A manually operable clamp for removing a margin strip from printer paper having sprocket feed margin strips containing spaced sprocket tooth receiving openings and detachably connected to the main body of the printer paper by a tear line of perforations, comprising:

upper and lower jaws connected by a longitudinal live hinge, each said jaw having an elongated rectangular clamping surface which is matingly engageable with a corresponding opposed elongated rectangular clamping surface on the other jaw;

one of said jaws having a portion that includes one of said clamping surfaces and has within said one clamping surface a plurality of aligned pin-receiving openings therein corresponding in size and spacing to said sprocket tooth receiving openings and said portion also having inwardly or said pin-receiving openings and parallel thereto longitudinally fence means against which the elongated edges of said margin strips abut when said sprocket tooth receiving openings therein are in registration with said pin-receiving openings; and said portion also having at one end only of said clamping surface an abutment against which one end of margin strip abuts;

the other jaw having a portion that includes the other of said clamping surfaces and has within said other clamping surface a plurality of aligned pins projecting therefrom corresponding in size, number and spacing to said pin-receiving openings and matingly insertable therein when said jaws are closed with said clamping surfaces engaged;

said live hinge having sufficient flexibility so as to allow sufficient shifting of said jaws relative to each other to permit said pins to enter said sprocket receiving holes in stacks of various thicknesses of said margin strips; and said portions of said jaws including said clamping surfaces being in the form of elongated U-shaped channels having floor portions interconnecting the side portions thereof and with said elongated rectangular clamping surfaces being the outer surfaces of the floor portions of said channels.

4. A manually operable clamp for removing a margin strip from printer paper having sprocket feed margin strips containing spaced sprocket tooth receiving holes and detachably connected to the main body of the printer paper by a tear line of perforations, comprising:

hinged upper and lower jaws, each jaw having an elongated rectangular clamping surface which has mating engagement with an opposed elongated rectangular clamping surface on the other jaw;

one of said jaws having a portion that includes one of said clamping surfaces and has within said one clamping surface a plurality of aligned pin-receiving openings therein corresponding in size and spacing to said sprocket tooth receiving openings and said portion also having inwardly of said pin-receiving openings and parallel thereto longitudinal fence means against which the elongated edges of said margin strips abut when said sprocket tooth receiving openings therein are in registration with said pin-receiving openings;

the other jaw having a portion that includes the other of said clamping surfaces and has within said other clamping surface a plurality of aligned pins projecting therefrom corresponding in size, number and spacing to said pin-receiving openings and matingly insertable therein when said jaws are closed with said clamping surfaces engaged; and said jaws defining therebetween a chamber for receiving and temporarily storing removed margin strips.

5. A manually operable clamp for removing a margin strip from printer paper having sprocket feed margin strips containing spaced sprocket tooth receiving openings and detachably connected to the main body of the printer paper by a tear line of perforations, comprising:

upper and lower jaws connected by a longitudinal live hinge, each said jaw having an elongated rectangular clamping surface which is matingly engageable with a corresponding opposed elongated rectangular clamping surface on the other jaw;

one of said jaws having a portion that includes one of said clamping surfaces and has a plurality of aligned pin-receiving openings within said one clamping surface corresponding in size and spacing to said sprocket tooth receiving openings and said portion also having inwardly of said pin-receiving openings and parallel thereto longitudinal fence means against which the elongated edges of said margin strips abut when said sprocket tooth receiving openings therein are in registration with said pin-receiving openings;

the other jaw having a portion that includes the other of said clamping surfaces and has a plurality of aligned pins projecting from said other clamping surface corresponding in size, number and spacing to said pin-receiving openings and matingly insertable therein when said jaws are closed with said clamping surfaces engaged; and said live hinge having sufficient strength so as to maintain said jaws partially open in the absence of applied pressure.

* * * * *

UNITED STATES PATENT AND TRADEMARK OFFICE

CERTIFICATE OF CORRECTION

PATENT NO. : 5,007,571

DATED : April 16, 1991

INVENTOR(S) : James S. Nasby and Michael J. Rood

It is certified that error appears in the above-identified patent and that said Letters Patent is hereby corrected as shown below:

Title Page:
In the Abstract, line 11, after "the", insert --openings and pins correspond to the size and spacing of the--.

Column 4, line 66, delete --and--.

Column 5, line 17, before "live", insert --said--.

Column 5, line 20, "thickness" should read "thicknesses".

Column 5, line 31, "jaw" should read "jaws".

Column 6, line 2, "or" should read "of".

Column 6, lines 3 and 4, "longitudinally" should read "longitudinal".

Signed and Sealed this

First Day of February, 1994

Bruce Lehman

*Attest:*

BRUCE LEHMAN

*Attesting Officer*

*Commissioner of Patents and Trademarks*